United States Patent [19]

Cocco et al.

[11] 4,375,012

[45] Feb. 22, 1983

[54] TAPERED RETRACTILE CORDS

[75] Inventors: Eugene R. Cocco, Baltimore, Md.; William G. Pflugrad, Norcross, Ga.; Byron L. Small, Baltimore, Md.

[73] Assignee: Western Electric Company, Incorporated, New York, N.Y.

[21] Appl. No.: 258,713

[22] Filed: Apr. 29, 1981

[51] Int. Cl.[3] ..... H01B 7/06

[52] U.S. Cl. ..... 174/69

[58] Field of Search ..... 174/69

[56] References Cited

U.S. PATENT DOCUMENTS

| | | | |
|---|---|---|---|
| 2,704,782 | 3/1955 | Ames | 174/69 |
| 3,988,092 | 10/1976 | Bloxham et al. | 425/150 |
| 4,090,763 | 5/1978 | Congdon et al. | 174/69 X |
| 4,123,585 | 10/1978 | Sparzak et al. | 428/379 |
| 4,166,881 | 9/1979 | Congdon et al. | 174/69 X |

*Primary Examiner*—Laramie E. Askin

*Attorney, Agent, or Firm*—E. W. Somers

[57] ABSTRACT

A retractile telephone cord of this invention has a retractility which decreases substantially linearly from each end to a center of its length and an extensibility which increases substantially linearly from each end to a center of its length. The cordage includes a plurality of conductors which are individually insulated with a first plastic material and which are disposed in a planar array, and a jacket of a second plastic material which encloses the array. The jacket is formed about the array to provide a cross-section transversely of the cordage which includes at least one side that is parallel to the array. In making the retractile cord, a length of the cordage is wound helically about a mandrel with the one side of the cross-section of the cord being in engagement with the mandrel. This prevents any axial twisting of the cordage as it is wound on the mandrel and subsequent to the heating of the cord and the reversing of the direction of the helical wind, results in a cord having the above-mentioned retractility and extensibility properties.

2 Claims, 7 Drawing Figures

TAPERED RETRACTILE CORDS

TECHNICAL FIELD

This invention relates to retractile cords. More particularly, it relates to a retractile telephone cord having a retractility which increases substantially linearly from a center of the cord to each end thereof and an extensibility which increases substantially linearly from each end to a center thereof.

BACKGROUND OF THE INVENTION

A familiar cord which is used with telephone station equipment is a retractile one and is made of cordage which is wound helically about a mandrel. The wound cordage is then subjected to a heat-treating temperature after which it is removed from the cord while the helical direction of wind is reversed. See, for example, U.S. Pat. Nos. 2,920,351 and 3,024,497 issed on Jan. 12, 1960 and on Mar. 13, 1962, respectively, in the names of E. C. Hardesty and D. L. Myers and U.S. Pat. No. 3,988,092, all incorporated by reference hereinto.

Retractile cords used on telephones to connect a handset to a base must have sufficient retractility to insure that they will return in a controlled gradual manner to their normal retracted form after having been extended and then released. However, such cords which are commonly known as spring cords must not be so strongly retractile that they require excessive forces to extend them. If a spring cord is too unyielding, the instrument to which it is connected may be removed on or pulled from its support. To prevent this, spring cords that are connected to lightweight desk-type or bedroom-type telephone handsets must be readily extensible.

While excessive retractility must be avoided, a cord must not be made so extensible that its distended helix fails to return to a retracted condition following use of the telephone. This is especially important in order to prevent unsightly, excessive sag of retractile cords which are used on wall-mounted telephones. Further, it is desirable that the retracted length of the spring cord be as short as possible.

Spring cords of the type used on telephones are generally constructed of cordage having a plurality of individually insulated, mandrelated flexible conductors comprising tinsel ribbons. In the past, each conductor was covered with a nylon knit and then insulated with a polyvinyl chloride (PVC) composition. Subsequently, the plurality of individually insulated conductors were jacketed with a PVC composition and had a circular cross-section. See, for example, U.S. Pat. No. 3,037,068 issued May 29, 1962 in the name of H. L. Wessel, incorporated by reference hereinto.

A new modular concept in telephone cord design includes the use of modular plugs for terminating the cord conductors. Jacks adapted to receive the plugs are mounted in the telephone housing or base and in a wall terminal thereby permitting easy replacement of either the line or spring cord by a customer or an installer. See, for example, U.S. Pat. Nos. 3,699,498 and 3,761,869 issued Oct. 17, 1972 and Sept. 25, 1973, respectively, in the names of E. C. Hardesty, C. L. Krumreich, A. E. Mulbarger, Jr. and S. W. Walden, and U.S. Pat. No. 3,860,316 issued Jan. 14, 1975 in the name of E. C. Hardesty, all incorporated by reference hereinto.

Conversion of modularity with its associated plug-terminated cordage necessitated the development of telephone cordage having a smaller cross-section than that used in the past. A cordage design suitable for use with modular plugs incorporated smaller conductors arranged in a parallel relationship, positioned in a single plane, and encapsulated with a flattened, oval-shaped jacket. To reduce the size of the insulated conductor, the knitted nylon covering over the served tinsel was eliminated and was replaced with a crystalline thermoplastic elastomer which is disclosed in U.S. Pat. No. 4,090,763 incorporated by reference hereinto and which serves as the primary retractile component in a spring-type telephone cord.

Telephone cords have high visibility coupled with high exposure to wear, staining and environmental degradation. Staining and discoloration are significant problems especially with equipment that receives heavy use and has a long service life. These problems have been overcome by a cord in which the jacket is coated as disclosed in U.S. Pat. No. 4,166,881 which was issued on Sept. 4, 1979 in the names of W. I. Congdon, J. J. Mottine and W. C. Vesperman. The coating has a stiffness modulus of about 1700 Kg/cm$^2$, as measured in accordance with ASTM specification D-747, which is substantially greater than that, i.e. about 70 Kg/cm$^2$, of the jacket material, but less than that, i.e. about 5300 Kg/cm$^2$, of the conductor insulation.

It has been found that if top coated cordage is formed into a spring cord configuration, it has excellent retractile properties. However, when top-coated cordage is formed on mandrels of automatic cord making apparatus such as that shown in U.S. Pat. No. 3,988,092 which was issued on Oct. 26, 1976 in the names of G. F. Bloxham et al, the finished cords are so strongly retractile that excessive forces must be applied to them to distend their convolutions.

This problem occurs not only because of the top coating but also because of the relatively small diameter of the convolutions of the cordage. That diameter which is about 0.64 cm. could be increased by forming the convolutions on larger diameter mandrels to achieve a top-coated cord having a larger diameter such as for example on the order of 0.95 cm. Although such cords are suitably extensible, they suffer from lack of retractility. This is particularly noticeable in cords which are used on wall-mounted telephones and which are desired to have an extended length of 7.6 meters and a retracted length of about 1 meter.

In the prior art, it has been recognized that it is sometimes desirable to have differential retractility along the length of the cord. For example, see U.S. Pat. No. 2,704,782 which was issued on Mar. 22, 1955 in the name of W. L. Ames in which such cords are made by regulating the amount of axial twist which is caused to be imparted to cordage prior to or during its winding on a tapered mandrel or both. Because of the construction of the cordage in the above-mentioned patent, including its circular cross-section and because of the manner in which it is wound on a mandrel, the wound cordage always possessed an amount of axial twist. The axial twist was necessary because the materials used to insulate the conductors and to form the jacket did not provide sufficient retracility after the cordage was wound and heat-treated and after the direction of the helix was reversed.

While the cord in the above-identified Ames patent provided a measure of differential retractility, the twist varies along the cord and modulated the retractility and extensibility. Moreover, not only does the geometry of modular cords not lend itself to the use of axial twisting, but the plastic materials, i.e. of the insulation covering and of the coating, impart retractility to the cord thus obviating the need for axial twist. What is needed and what does not appear to be included in the prior art is a retractile cord of modulator construction which has a controlled extensibility as well as retractility to permit facile extension with assurance of convolution return to a compact helix.

The problem is to provide a cord which desirably may be made on existing capital equipment and which, while relatively long, has sufficient retractility to prevent sag. Moreover, it must be one which is sufficiently extensible so as not to require excessive forces to move a handset which is connected through the cord to a base. The sought-after cord should be one in which the extensibility and the retractility vary inversely linearly between the ends and the center of the cord. While the prior art includes top-coated cords and cords having varying retractility brought on by a combination of overtwist, axial twist and/or tapering, the art does not appear to provide a cord that meets the foregoing needs.

SUMMARY OF THE INVENTION

A retractile telephone cord which meets the requirements outlined hereinabove is the cord of this invention and one which includes a plurality of relatively flexible conductors which are individually insulated with a crystalline thermoplastic elastomer material and which are disposed in a planar array. The array is enclosed in a plastic jacket such as for example a plasticized polyvinyl chloride (PVC) composition which has a surface coating of a plastic material having a stiffness modulus which is substantially greater than that of the jacket plastic but which is substantially less than that of the conductor insulation. The cross-sectional configuration of the jacket in a direction transverse of the array has one side that is parallel to the array.

The top coated cordage is wound into a helix on a mandrel with adjacent convolutions decreasing in diameter from a center of the cord length to each end thereof and with the side that is parallel to the array being adjacent the mandrel. The inside diameter of the maximum and minimum size convolutions is controlled to provide a cord having a retractility which increases substantially linearly from a center of the cord to each end and an extensibility which increases substantially linearly from each end to a center of the cord. In further steps of making the cord, the wound cordage is subjected to a temperature which is substantially close to the melting point of the jacket plastic and which permits recrystallization of the conductor insulation. This causes any strain which has been mechanically imparted to the cordage during winding to be substantially removed. Then the cordage is removed from the mandrel in a manner which causes the direction of helical wind to be reversed.

BRIEF DESCRIPTION OF THE DRAWINGS

Other objects and features of the present invention will be more readily understood from the following detailed description of specific embodiments thereof, when read in conjunction with the accompanying drawings, in which.

DETAILED DESCRIPTION

Figure 1:
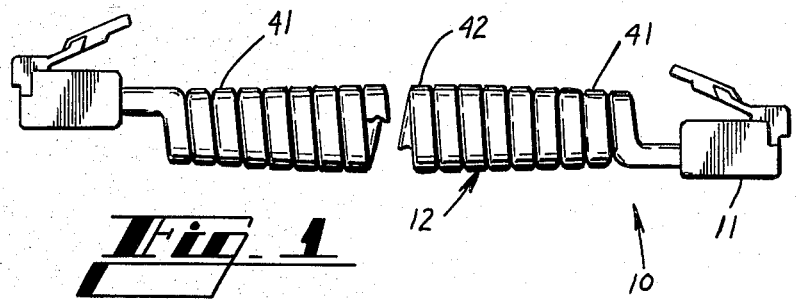
FIG. 1 is a side elevational view of the cord of this invention, said cord including a length of cordage being wound in a retractile configuration and having each of its ends terminated with a modular plug.
Figure 2:
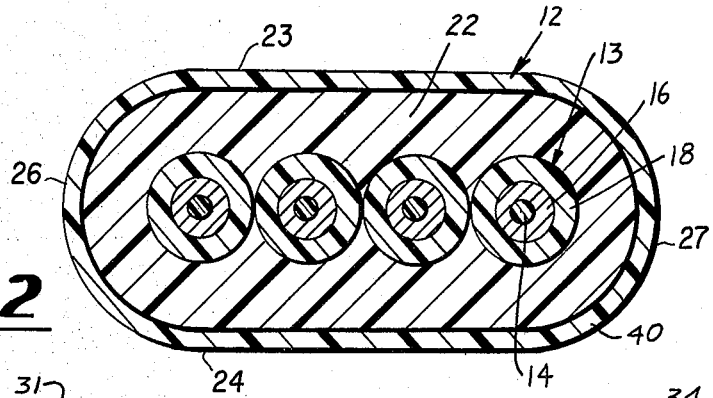
FIG. 2 is a cross-sectional end view of the cordage in FIG. 1.

Referring now to FIGS. 1 and 2, there is shown a retractile or spring cord, designated generally by the numeral 10, each end of which is terminated with a modular plug 11. The spring cord 10 is the type which is used on telephone instruments and which includes a length of cordage 12 having a plurality of insulated tinsel conductors, designated generally by the numerals 13—13. Each of the insulated conductors 13—13 includes a nylon multi-filament center core, designated generally by the numeral 14, about which a plurality of tinsel ribbons 16—16, made typically from a Phosphor-bronze material, are wrapped spirally to form a tinsel conductor.

An insulation cover 18 of a suitable plastic material is extrusion-tubed ove the tinsel ribbons 16—16 to form one of the insulated tinsel conductors 13—13. This insulation cover 18 may be comprised of a material such as that disclosed in U.S. Pat. No. 4,090,763 which is incorporated by reference hereinto. The served tinsel conductor construction provides a high degree of flexibility and fatigue life as compared to a solid conductor design.

A plurality of the insulated tinsel conductors 13—13 are arranged in a planar array in parallel, nontwisted, relationship with respect to each other so that the insulated conductors are symmetrical with respect to a common longitudinal axis therebetween. This arrangement facilitates identification by an installer and obviates the use of color-coded insulation.

A jacket 22 of a suitable plastic material is extruded over the insulated tinsel conductors 13—13 to form the cordage 12. A plastic material suitable for use as a jacket is that disclosed in U.S. Pat. No. 4,123,585 issued in the names of W. J. Sparzak and W. C. Vesperman, which is incorporated by reference hereinto. As can be seen in FIG. 2, the cross-sectional configuration of the jacket 22 includes two linearly parallel sides 23 and 24 which are connected by curved ends 26 and 27. Typically, the distance between the sides 23 and 24 is about 0.22 cm and that between the outermost portions of the curved ends 26 and 27 is about 0.48 cm.

The jacketed cordage 12 may also be formed into spring cords 10—10 of various lengths having different numbers of insulated conductors 13—13 therein. For example, the number of insulated conductors 13—13 is commonly three to eight, and the nominal extended lengths of the cords are commonly 1.8, 3.7 and 7.6 meters. The spring cords 10—10 are formed preferably as disclosed in priorly identified U.S. Pat. Nos. 2,920,351, 3,024,497 and 3,988,092. Subsequently, one of the modular plugs 11—11 (see FIG. 1) made in accordance with the disclosure of hereinbefore mentioned U.S. Pat. Nos. 3,699,498, 3,761,869 or 3,860,316 is assembled to each end of the length of cordage 12 to form a telephone cord. See U.S. Pat. No. 3,895,434 issued July 22, 1975 in the names of G. P. Adams, F. D. Gavin, Jr. and A. P. Natale.

Figure 3:
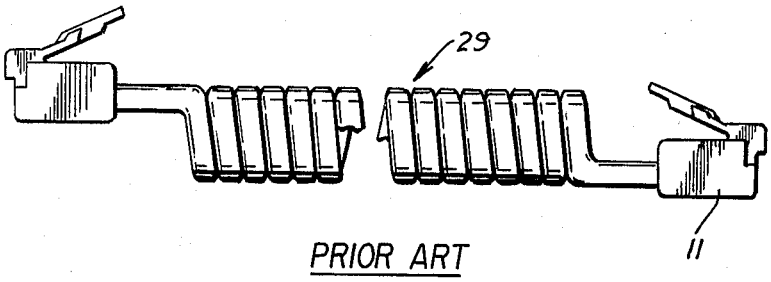
FIG. 3 is a side-elevational view of a prior art cord.

The cordage 11 as described thus far is either formed into predetermined length line cords or is wound on mandrels as a first step in forming retractile or spring cords. In the past, the cordage 12 has been wound on constant diameter mandrels to provide a cord 29 having constant diameter convolutions as shown in FIG. 3. In accordance with the methods of this invention, cordage 12 is wound to provide a cord 10 having controlled retractility and extensibility properties.

Figure 4:
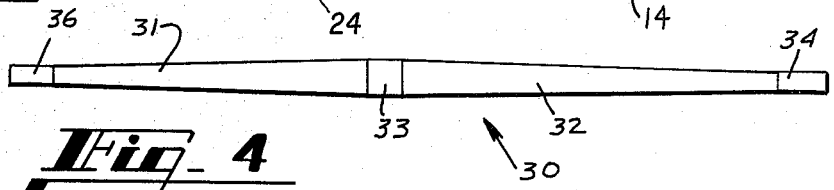
FIG. 4 is a side elevational view of a mandrel on which cordage is wound to form the cord of this invention.

A mandrel on which are wound convolutions of cordage is designated generally by the numeral 30 and is shown in FIG. 4. The mandrel 30 includes two tapered portions 31 and 32 each having a large diameter end and a small diameter end. The portions 31 and 32 are formed so that the large diameter portions are adjacent to each other with the small diameter portions being at opposite ends of the mandrel.

In a preferred embodiment of this invention, the mandrel 30 is formed without any portion such as, for example, a center portion, having a constant diameter. Since such a mandrel is expensive to manufacture, a compromise includes a relatively short center length 33 of constant diameter.

As will be recalled, the coiling of top coated cordage on a presently used mandrel which has a diameter of 0.64 cm results in a cord having excessive retractility. The mandrel 30 of this invention is sized so that its small end portions 34 and 36 have a diameter of about 0.64 cm with a centerline diameter of about 0.87 cm.

In the past, as explained for example in U.S. Pat. No. 2,704,782, the prior construction cordage having a circular cross-section had been overtwisted prior to coiling on a constant diameter mandrel. That construction cordage included a jacket whcih was made of a highly elastic, cured elastomeric material. Then, as the cordage was wound with one end clamped at one end of the mandrel and one end clamped elsewhere, the cordage advancing to the mandrel rubbed against the turn thereof that had just been wound on the mandrel. The rubbing removed some of the overtwist from the portion of the cordage going onto the mandrel.

As the rubbing of the cordage on the adjacent turns on the mandrel continued, the build-up in the twist in the uncoiled portion of the cordage continued and the overtwist on the portion of the cordage going onto the mandrel gradually increased. After it had been coiled, the cordage was heated to such an extent that substantially all the strain in the jacket except some of that from the axial twisting thereof was removed. Upon cooling, the jacket held the cordage in the form on which it was wound on the mandrel.

The axial twisting in making the prior style cord occurred because the cordage had a circular cross-section which was caused to roll axially by the rubbing action of the relatively high friction surface of the elastomeric jacket as successive adjacent cords were wound on the mandrel. Therefore, even though intentional overtwisting was omitted, a certain amount of axial twist was inherent in the cord. As a result, even though the overtwist was varied or a tapered mandrel was used, the end product cord had a retractility and an extensibility which was modulated by the axial twist. The cumulative effect of overtwist and/or tapered convolutions plus the axial twist was a non-uniformly varying retractility and extensibility.

The cordage which is coiled to produce the cord of this invention differs from prior art cordage in several respects. First of all, the conductors are disposed in a planar array as viewed through an end cross-section of the cordage 12. The configuration of the end cross-section is such that the portion which engages the mandrel upon winding is linear. As a result, when the cordage is wound on a mandrel, there is no turning of the cordage and hence no axial twist imparted thereto. In the preferred embodiment as shown in FIG. 2, the end cross-section includes two linearly parallel sides joined by radiused ends.

Secondly, the plastic insulating and jacketing materials are different from those of the prior art cordage. The insulation cover 18 of each conductor 13 comprises a plastic material having a stiffness modulus in the range of about 5300 $Kg/cm^2$ which is substantially greater than the 1700 $Kg/cm^2$ stiffness modulus of the jacket plastic. When subjected to the heating step, substantially all the strain which is imparted to the cord is removed. The retractile properties are acquired when the heated cord on the mandrel is cooled and then removed from the mandrel as simultaneously the helical direction of wind is reversed. The increased strain which is imparted by the reversing operation creates a torsional effect which increases the retractility of the finished cords. Unlike prior art cords, the plastic material of the insulation cover 18 provides sufficient retractility without the necessity of using axial twist.

To reduce the problem of distended helices after a period of use when the cord is not supported along its length, the cordage 12 is coated with a relatively thin layer 40, e.g. about 0.005 cm, of a polyester material (see FIG. 2). Because of its relatively high stiffness modulus, the polyester coating supplements the conductor insulating material and enhances the cord's retractility. However, the increase in retractility is accompanied by the undesirable need to apply correspondingly greater tension to extent the cord 10 to its rated length. Increasing the diameter of the forming mandrel 30 solves the extensibility problem of coated cords but not only does it requires expensive changes to the existing automatic machinery, it also reintroduces the problem of retractibility deterioration during use as manifested in excessive sag.

The solution in accordance with this invention is a cord which has been made by winding a length of the cordage 12 coiled on the mandrel 30. Cords 10—10 formed on such mandrels have gradually and uniformly decreasing retractility and accompanying uniformly increasing extensibility per unit length from the small diameter outer ends 41—41 (see FIG. 1) to larger diameter central portions 42—42. The gradually increasing extensibility allows the cords 10—10 to be extended to their nominally rated lengths with reasonable force. Conversely, the gradually increasing retractility per length measured from the central portion returns the cord 10 to a compact closed configuration when tension is removed.

In the free hanging condition, which most long cords experience, the coils need to support progressively less weight as the distance from the ends 41—41 approaches the central portion 42. Consequently, the spring rate may be allowed to decrease continuously from both ends toward the center. The spring rate follows a spring wire formula which is set forth as $$K=d^4G/64R^3N \quad (1)$$

where d = wire diameter (distance between sides 23 and 24 of jacket 22), K = spring rate, G = modulus of elasticity in shear, R = mean radius of the helix, and N = number of active coils (total number of convolutions in cord 10).

In the retractile cord, the spring rate is constantly changing with cord length and is inversely proportional to the cube of the mean radius of the helix.

From equation (1) and from the arrangement in which each succeeding convolution supports less of the weight of the cord 10, the optimum configuration is one in which the mandrel 30 tapers to a maximum at the cord center and immediately begins to decrease without any central constant diameter portion.

Figure 5B:
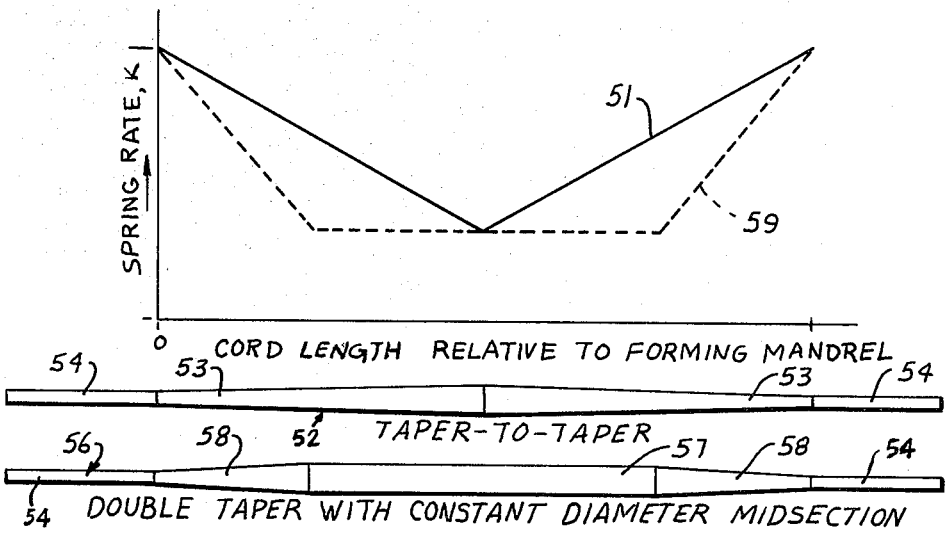
FIGS. 5A and 5C are graphs showing plots of the spring rate of the cordage of FIG. 2 along its length after having been wound on mandrels of constant diameter, of taper on one end of taper on each end.
Figure 5A:
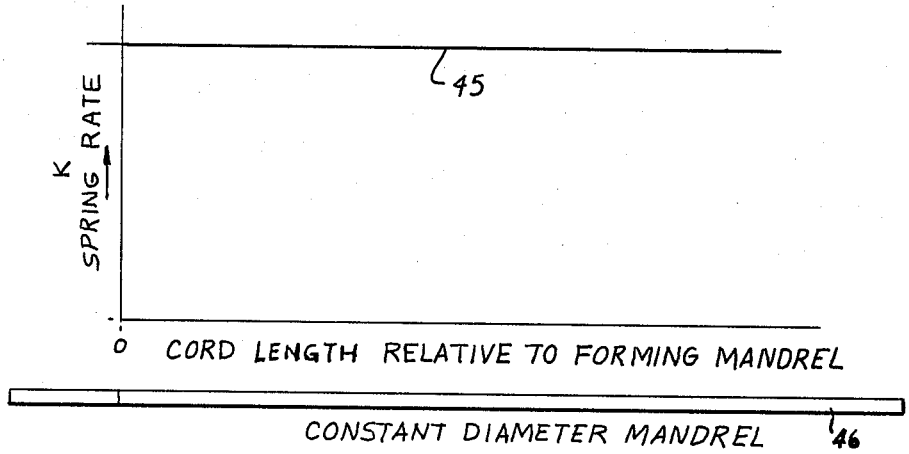

Referring now to FIG. 5, there are shown a series of graphs which illustrate the controlled retractility and extensibility in terms of spring rate that are provided by the cord 10 of the invention. FIG. 5(A) shows a graph 45 of the spring rate for a modular cord which is presently used and which has constant diameter convolutions along its length as a result of using a constant diameter mandrel 46. As is seen, the graph is linear with a constant spring rate.

Going now to FIG. 5(B), there is shown a graph 51 of the preferred embodiment of this invention in which cordage 12 is wound on a mandrel 52 having two contiguous tapered lengths 53—53 with end portions 54—54 for mounting in chucks of cord-making apparatus. Advantageously, the spring rate increases substantially linearly from a minimum value at the center of the cord to a maximum value at each end. This causes the cord 10, particularly when used with a wall-mounted telephone in which it assumes a catenary configuration, to be able to resist sag as a function of time and yet be readily extensible because of its center having the low spring rate.

While the preferred embodiment of the cord 10 includes two tapered portions having their largest diameter convolutions contiguous at the center of the cord, an alternative includes a relatively short length central section having constant diameter convolutions. In FIG. 5(B), a mandrel 56 having a constant diameter section 57 and two end winding sections 58—58 is shown. For purposes of illustration, the length of the constant diameter section 57 is exaggerated. In practice, it has a length of about 0.7 cm. The accompanying graph of a cord which is produced on such a mandrel is designated 59 and is shown in dotted lines in FIG. 5(B).

Figure 5C:
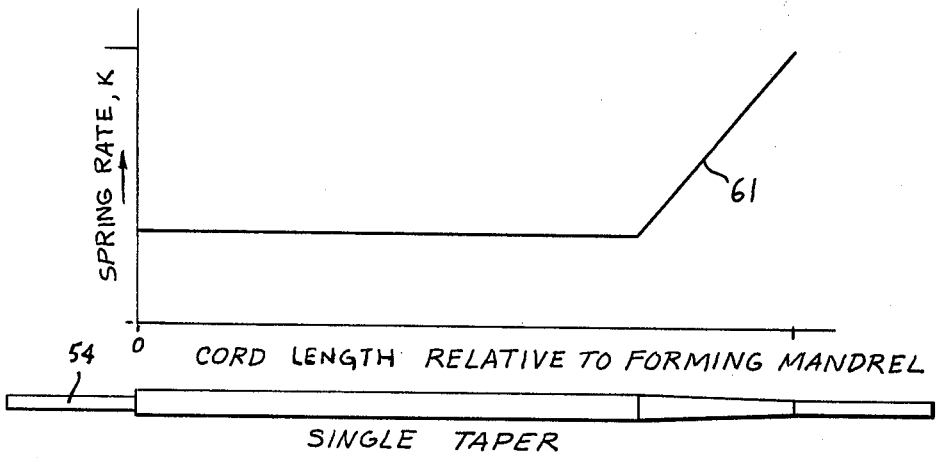

There may be instances when there is needed an unsymmetrical retractile cord having a constant diameter portion with one tapered portion extending therefrom or one which is tapered from one end to the other. A graph 61 of the spring rate along the length of the former of these two kinds of unsymmetrical cords is shown in FIG. 5(C).

In contrast to the cord 10 of this invention, the prior art so-called round style cordage as described in U.S. Pat. No. 2,704,782 would not possess such properties. The spring rate was affected by the combination of a non-uniform mandrel, intentional overtwist which was imparted to the cordage prior to winding, and the axial twist which was inherent in the process as a result of the configuration of the cordage cross-section and of the materials of the jacket. Since the overtwist, if used, generally was increased from one end to the other, and since the axial twist increased, albeit non-uniformly, from one end of the cord to another, the resulting spring rate graph was unsymmetrical with values being greater at one end than at the other.

While the cord 10 of this invention in the preferred embodiment has been described as one having the top coating, it should be understood that this invention is not so limited. The top coating 41 is used for mechanical protection and to enhance retractility. If a material were to be found which could be used for the insulation cover 18 and which had a stiffness modulus which is greater than that of the presently used material and if a more mechanically resistant jacket material were used, the top coating may be omitted.

It is to be understood that the above-described arrangements are simply illustrative of the invention. Other arrangements may be devised by those skilled in the art which will embody the principles of the invention and fall within the spirit and scope thereof.

What is claimed is:

1. A tapered retractile cord which is made from cordage which includes a plurality of flexible conductors that are disposed in a substantially planar array with each of said conductors being insulated with a first thermoplastic material, a jacket which is made of a second thermoplastic material having a stiffness modulus that is substantially less than that of said first thermoplastic material and which encloses said planar array of conductors in a cross-sectional configuration having an inwardly facing side that is parallel to said array, and a coating which covers said jacket and which comprises a plastic material having a stiffness modulus that is substantially greater than that of said second thermoplastic material of said jacekt, said tapered cord including cordage being wound in a helical configuration and being substantially continuously tapered with convolutions thereof increasing in diameter from one end of the tapered cord to a portion intermediate its ends and then decreasing in diameter from said intermediate portion to its other end to provide said tapered cord with a controlled extensibility which increases substantially linearly from each end to said intermediate portion whereat the extensibility exceeds that of a cord comprising said cordage wound along its length in uniform convolutions having a diameter equal to the diameter of end convolutions of said tapered cord.

2. The retractile cord of claim 1, wherein said first thermoplastic material is a crystalline thermoplastic elastomer having a crystallization temperature relative to the melting point of said second thermoplastic material such that any strain that is mechanically introduced into said first and second thermoplastic materials when said cordage is wound in the helical configuration is capable of being removed when said cordage is subjected to a treating temperature that approaches the melting point of said second thermoplastic material.

* * * * *